US007942130B2

(12) United States Patent
Briggs et al.

(10) Patent No.: US 7,942,130 B2
(45) Date of Patent: May 17, 2011

(54) REGULATOR FLOW NOISE PREVENTION FOR FUEL SYSTEM OF A VEHICLE

(75) Inventors: Paul F. Briggs, Grand Blanc, MI (US); Jeffery J. Milton, Lake Orion, MI (US)

(73) Assignee: Continental Automotive Systems US, Inc., Auburn Hills ( * ) Notice: Subject to any disclaimer, the term of this patent is extended or adjusted under 35 U.S.C. 154(b) by 249 days.

(21) Appl. No.: 12/076,317

(22) Filed: Mar. 17, 2008

(65) Prior Publication Data

US 2008/0232989 A1 Sep. 25, 2008

Related U.S. Application Data

(60) Provisional application No. 60/919,249, filed on Mar. 21, 2007.

(51) Int. Cl.
*F02M 63/00* (2006.01)
*F02M 57/02* (2006.01)

(52) U.S. Cl. ..... 123/447; 123/457; 123/467

(58) Field of Classification Search ..... 123/447, 123/456–461, 463, 467, 497, 509, 515; 137/565.17
See application file for complete search history.

(56) References Cited

U.S. PATENT DOCUMENTS

| | | | | |
|---|---|---|---|---|
| 3,949,714 | A * | 4/1976 | Mitchell | 123/458 |
| 4,418,671 | A * | 12/1983 | Kelso et al. | 123/450 |
| 4,449,507 | A * | 5/1984 | Mayer | 123/467 |
| 4,527,528 | A * | 7/1985 | Finn et al. | 123/447 |
| 5,526,795 | A * | 6/1996 | Thompson et al. | 123/516 |
| 5,579,739 | A * | 12/1996 | Tuckey et al. | 123/467 |
| 5,727,529 | A * | 3/1998 | Tuckey | 123/514 |
| 5,878,718 | A | 3/1999 | Rembold et al. | |
| 5,983,863 | A * | 11/1999 | Cavanagh et al. | 123/447 |
| 7,380,541 | B1 * | 6/2008 | Ricco et al. | 123/447 |
| 7,395,818 | B2 * | 7/2008 | Fujisawa et al. | 123/527 |
| 7,574,994 | B2 * | 8/2009 | Scheurer et al. | 123/447 |

FOREIGN PATENT DOCUMENTS

| | | |
|---|---|---|
| EP | 0899453 A | 3/1999 |
| EP | 0984158 A | 2/2000 |
| EP | 1219828 A | 9/2002 |

* cited by examiner

*Primary Examiner* — Stephen K Cronin
*Assistant Examiner* — Johnny H Hoang

(57) ABSTRACT

Vapor reducing structure (25) is constructed and arranged to be associated with a fuel pressure regulator (18) of a fuel system (10') of a vehicle. The pressure regulator has an outlet (28) for fuel that is in excess of fuel required by an engine of the vehicle. The reducing structure includes a fuel accumulator (26) associated with an outlet of the pressure regulator defining a volume in which fuel exiting the outlet of the regulator can accumulate. Flow restricting structure (30') is associated with the accumulator and is constructed and arranged to create sufficient back-pressure to eliminate vaporization of the fuel exiting the outlet of the pressure regulator.

10 Claims, 1 Drawing Sheet

REGULATOR FLOW NOISE PREVENTION FOR FUEL SYSTEM OF A VEHICLE

This application claims the benefit of the earlier filing date of U.S. Provisional Application No. 60/919,249, filed on Mar. 21, 2007, the content of which is hereby incorporated by reference into this specification.

FIELD OF THE INVENTION

This invention relates to vehicle fuel systems and, more particularly, to reducing noise caused by fuel vaporizing at an outlet of a fuel regulator of the system.

BACKGROUND OF THE INVENTION

In some of today's automotive applications, higher flow rate fuel pumps are necessary to keep up with increased engine demand at wide open throttle. A typical mechanically regulated system uses a fuel regulator to deliver the exact amount of fuel necessary to the engine, and returns the unused fuel back to the fuel module. When that same vehicle is running at idle, nearly all of the fuel output from the fuel pump is directed through the pressure regulator. Due to the design of the regulator, the fuel is sheared as it passes through the regulator, vaporizing the fuel and creating small bubbles. This shearing of the fuel and generation of bubbles in turn causes an audible noise to be generated from the pressure regulator. This noise is often audible inside the passenger compartment and is undesirable to the customer.

Thus, there is a need to prevent the bubbles from forming and creating noise at the outlet of a fuel regulator.

SUMMARY OF THE INVENTION

An object of the invention is to fulfill the need referred to above. In accordance with the principles of the present invention, this objective is obtained by providing vapor reducing structure constructed and arranged to be associated with a fuel pressure regulator of a fuel system of a vehicle. The pressure regulator has an outlet for fuel that is in excess of fuel required by an engine of the vehicle. The reducing structure includes a fuel accumulator associated with an outlet of the pressure regulator defining a volume in which fuel exiting the outlet of the regulator can accumulate. Flow restricting structure is associated with the accumulator and is constructed and arranged to create sufficient back-pressure to eliminate vaporization of the fuel exiting the outlet of the pressure regulator.

In accordance with another aspect of the disclosed embodiment, vapor reducing structure is constructed and arranged to be associated with a fuel pressure regulator of a fuel system of a vehicle. The pressure regulator has an outlet for fuel that is in excess of fuel required by an engine of the vehicle. The vapor reducing structure includes means, associated with an outlet of the pressure regulator, for accumulating fuel, and means, associated with the accumulator, for restricting fuel flow so as to create sufficient back-pressure to eliminate vaporization of the fuel exiting the outlet of the pressure regulator.

In accordance with yet another aspect of an embodiment of the invention, a method is provided to reduce noise of a pressure regulator of a fuel system of a vehicle. The method permits fuel to accumulate at an outlet of the pressure regulator, and restricts flow of the accumulated fuel to create sufficient back-pressure to eliminate vaporization of the fuel exiting the outlet of the pressure regulator.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
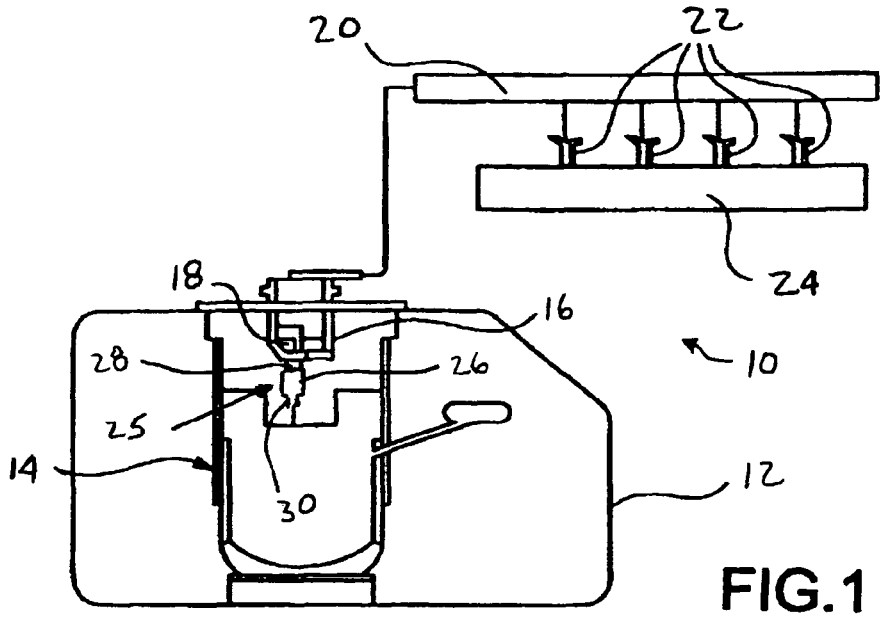
FIG. 1 is view of a vehicle fuel system in accordance with an embodiment of the invention.

With reference to FIG. 1, a vehicle fuel system, generally indicated at 10, includes a tank 12, a fuel pump, generally indicated 14, a filter 16, a pressure regulator 18, a fuel rail 20, at least one fuel injector 22, and an internal combustion engine 24. Conventional piping fluidly interconnects these components. Fuel is stored in the tank 12 on-board a vehicle. The fuel is withdrawn from the tank by the pump 14 and fed through the filter 16 to the fuel rail 20 and thus to the fuel injectors 22, which deliver the fuel to combustion cylinders in the engine 24. The pressure at which the fuel is supplied to the fuel rail 20 must be metered to ensure the proper operation of the fuel injectors 22. Metering is carried out using the pressure regulator 18 that controls the pressure of the fuel in the system at all levels of engine speed.

In accordance with an embodiment of the invention, vapor reducing structure, generally indicated at 25, is associated with the pressure regulator 18. The vapor reducing structure 25 includes an accumulator 26 coupled with the outlet 28 of the pressure regulator 18 so that fuel passing through the outlet 28 accumulates in the accumulator 26. The accumulator 26 is preferably a tube having a volume sufficient to accumulate fuel therein. The tube 26 can be separate from or part of the pressure regulator 18.

The vapor reducing structure 25 also includes fluid restricting structure 30 provided at an outlet of the accumulator 26. In the embodiment of FIG. 1, the fuel restricting structure 30 is in the form of an orifice, the outlet of which permits fuel to return to a reservoir of a fuel module or directly to the fuel tank. The orifice 30 is sized to create sufficient back-pressure to eliminate vaporization of fuel exiting the outlet of the pressure regulator 18. The orifice 30 can be integral with the accumulator 26 or be a separate part coupled thereto.

Figure 2:
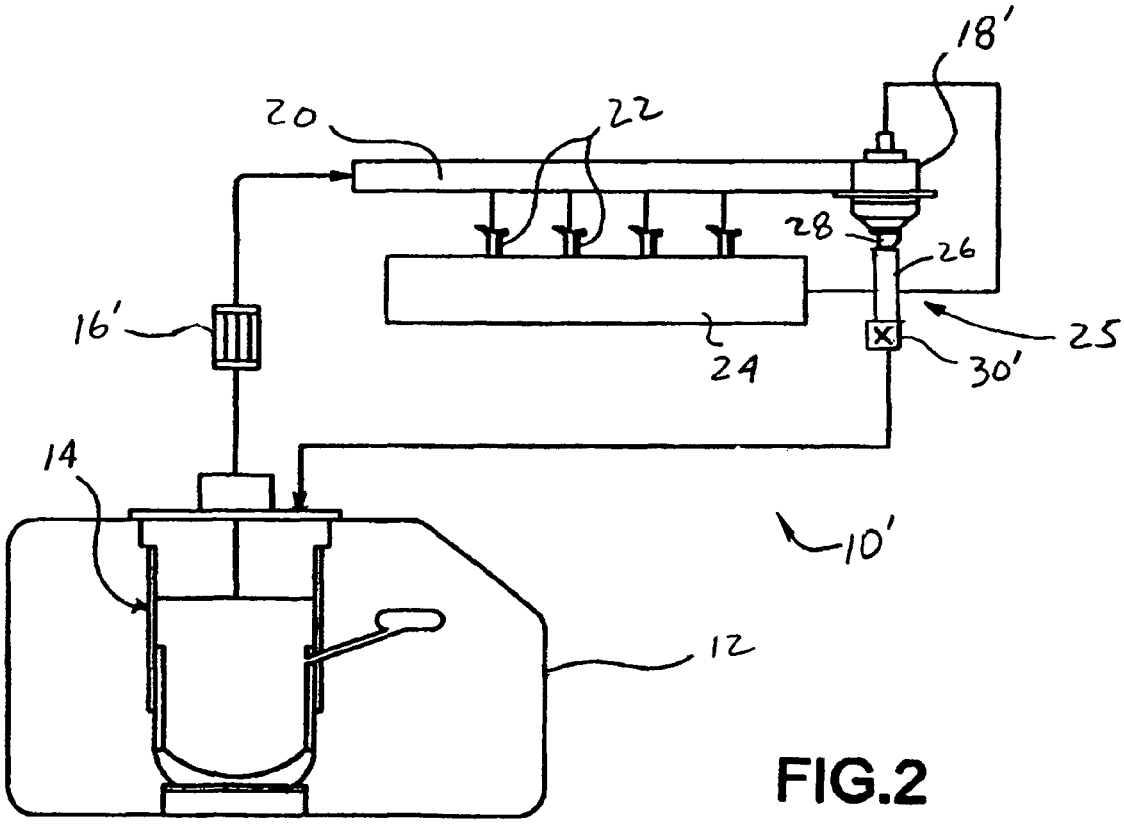
FIG. 2 is view of a vehicle fuel system in accordance with another embodiment of the invention.

With reference to FIG. 2, a vehicle fuel system 10' is shown in accordance with another embodiment of the invention. In this embodiment, the fuel filter 16' and pressure regulator 18' are disposed outside of the fuel tank 12. Fuel is stored in the tank 12 on-board a vehicle. The fuel is withdrawn from the tank by the pump 14 and fed through the filter 16 to the fuel rail 20 and thus to the fuel injectors 22, which deliver the fuel to combustion cylinders in the engine 24. As in the embodiment of FIG. 1, the pressure at which the fuel is supplied to the fuel rail must be metered to ensure the proper operation of the fuel injectors. In FIG. 2, the metering is carried out by the pressure regulator 18' mounted at the fuel rail 20. Excess fuel from outlet 28 of the pressure regulator returns to a reservoir of the fuel module or directly to the tank 12.

As shown in FIG. 2, the accumulator 26 is coupled with the outlet 28 of the pressure regulator 26 as in FIG. 1. However, in FIG. 2, the fuel restricting structure of the vapor reducing structure 25 is in the form of a valve 30' coupled with the accumulator 26 to create sufficient back-pressure to eliminate vaporization of fuel exiting the outlet of the pressure regulator 18. The fuel restricting structure was found to work best as a variable sized orifice created by way of a conventional duck-bill valve 30', however, any type of valve can be employed.

Although the orifice 30 is used in the embodiment of FIG. 1, where the pressure regulator 18 disposed within the fuel tank 12, it can be appreciated that the orifice 30 can be used in the embodiment of FIG. 2 instead of the valve 30'. Furthermore, the valve 30' can be used in place of the orifice 30 in FIG. 1.

Thus, the accumulator 26 and fuel restricting structure 30, 30' prevent vaporization and thus bubbling of the fuel as it exits the pressure regulator 18, 18', thereby reducing noise generated by the pressure regulator.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. Vapor reducing structure constructed and arranged to be associated with a fuel pressure regulator of a fuel system of a vehicle, the pressure regulator having an outlet for fuel that is in excess of fuel required by an engine of the vehicle, the vapor reducing structure comprising:

a fuel accumulator associated with an outlet of the pressure regulator defining a fixed volume in which fuel exiting the outlet of the regulator can accumulate, and a variable sized orifice defining flow restricting structure associated with the accumulator and constructed and arranged to alone create sufficient back-pressure to eliminate vaporization of the excess fuel exiting the outlet of the pressure regulator and to permit the excess fuel to be returned directly to a source of fuel.

2. The structure of claim 1, wherein the orifice is part of a valve.

3. The structure of claim 2, wherein the valve is a duck-bill valve.

4. The structure of claim 1, wherein the accumulator is a tube.

5. The structure of claim 1, wherein the flow restricting structure is integral with the accumulator.

6. The structure of claim 1, in combination with the pressure regulator.

7. The combination of claim 6, wherein the accumulator is integral with the pressure regulator.

8. A method of reducing noise of a pressure regulator of a fuel system of a vehicle, the method comprising:

permitting fuel to accumulate in an accumulator of fixed volume at an outlet of the pressure regulator, and restricting flow of the accumulated fuel by a variable sized orifice defining flow restricting structure to alone create sufficient back-pressure to eliminate vaporization of excess fuel exiting the outlet of the pressure regulator, and permitting the excess fuel to return to a source of fuel directly from the flow restricting structure.

9. The method of claim 8, wherein the permitting step includes providing the accumulator at the outlet of the pressure regulator.

10. The method of claim 8, wherein the orifice is part of a duck-bill valve.

* * * * *